United States Patent [19]

Scalzo et al.

[11] 3,973,727

[45] Aug. 10, 1976

[54] THERMOSTATICALLY CONTROLLED SAFETY DEVICE FOR OIL BURNERS

[76] Inventors: Joseph E. Scalzo; John Tulowitzki, both c/o 234 E. College Ave., State College, Pa. 16801

[22] Filed: Nov. 18, 1974

[21] Appl. No.: 524,961

[52] U.S. Cl. ..... 236/11; 219/508; 337/338

[51] Int. Cl.[2] ..... F23N 5/24

[58] Field of Search ..... 236/10, 11, 1 A; 337/338; 219/508

[56] References Cited

UNITED STATES PATENTS

| | | | |
|---|---|---|---|
| 1,500,382 | 7/1924 | Gannon et al. | 219/508 |
| 2,936,360 | 5/1960 | Suarez | 219/508 |
| 3,242,293 | 3/1966 | Manecke | 337/338 |

*Primary Examiner*—William E. Wayner
*Attorney, Agent, or Firm*—Thomas E. Sterling

[57] ABSTRACT

This invention is comprised of a thermostatically controlled safety circuit and device used in conventional hot air oil burning furnaces which automatically turns the oil burner off when the temperature of the room heated by the furnace becomes abnormally hot. By so doing an overheated furnace and possible fire is avoided. The invention is comprised of a line voltage or safety thermostat positioned at or near the location of the conventional furnace thermostat. The line voltage thermostat is connected between the limit switch and the control circuit of the furnace control circuit. A variation of the invention is comprised of the line voltage thermostat or safety thermostat connected or ganged with the conventional furnace thermostat so that the line voltage thermostat will be activated at a higher temperature than the conventional thermostat.

6 Claims, 3 Drawing Figures

THERMOSTATICALLY CONTROLLED SAFETY DEVICE FOR OIL BURNERS

This invention relates in general to safety devices more particular to thermostatically controlled safety devices which are used on oil burning furnaces.

The conventional hot air oil burning furnace is comprised of a low voltage thermostat which is wired to a control circuit which switches the furnace burner on and off. A limit swtich is positioned between the power source and the control circuit. The limit switch controls the temperature in the combustion chamber by controlling the power to the control circuit. There is a safety circuit in the control circuit which will shut off the furnace burner if it fails to ignite. However, there is no automatic circuit that will control the temperature in the room if the control becomes defective and effectively shorts out the room thermostat.

The circuits for this invention are the same as those of the conventional hot air oil burning except for a line voltage thermostat whose current supply is independent of other furnace components. This line voltage thermostat is manually connected or ganged to the low voltage thermostat so that it breaks its electrical contacts about 10° F. higher than the low voltage thermostat. When the setting on the low voltage thermostat is manually reset, the setting on the line voltage thermostat is also reset automatically.

The line voltage thermostat is wired between the limit switch and the control circuit. If the low voltage thermostat becomes effectively shorted out in the control circuit then the line voltage thermostat will control the temperature in the room, keeping it about 10° Fahrenheit above the setting on the low voltage thermostat. For example, if the low voltage thermostat is set at 70° F., then the line voltage thermostat would be set at 80° F. If the low voltage thermostat becomes shorted either in the control circuit or elsewhere, then the line voltage thermostat would regulate the temperature, keeping it at 80° F.

If the line voltage thermostat is not in the circuit and the low voltage thermostat becomes shorted out, in the control circuit or elsewhere then the burner will operate until some other furnace part becomes defective, or the burner is turned off manually. There is a very real danger that the furnace will eventually catch the building on fire if left to run continuously.

In an adaptation of this invention both the line voltage thermostat and the low voltage thermostat are coupled to a connection rod which connects the two shafts together so when the low voltage thermostat is reset the line voltage thermostat is also reset. In such an arrangement a neon light is turned on when the contacts in the line voltage thermostat are broken. If the line voltage thermostat is in control, and the temperature is reached at which the line voltage thermostat is set, then the contacts in the line voltage thermostat will break and the neon light will light, signaling that the temperature is reached and that there is a problem in the low voltage thermostat's circuit.

In a second adaptation of the invention two separate thermostats may be used that are not manually connected. In this case the line voltage thermostat would be set at the highest temperature you would ever require in the room and locked at this setting. Then, if the low voltage thermostat became effectively shorted, the line voltage thermostat will act as a safety limit switch, thus regulating the temperature until the problem can be corrected.

An object of this invention is to provide a safety device which will turn off an oil burner furnace if the room temperature rises above a predetermined degree.

Another object of this invention is to provide a thermostatically controlled device which will turn off the oil burner's circuit should the safety control device of the oil burner fail.

Still another object of this invention is to provide a unique device for the ganging of two thermostats.

Another object of this invention is to provide a safety thermostat whose current supply is independent of that supplied by internal furnace components.

Yet another object of this device is to provide a ganged thermostat which operates from one turning shaft.

Other objects and a fuller understanding of the invention may be had by referring to the following description and claims taken in conjunction with the drawings.

Figure 1:
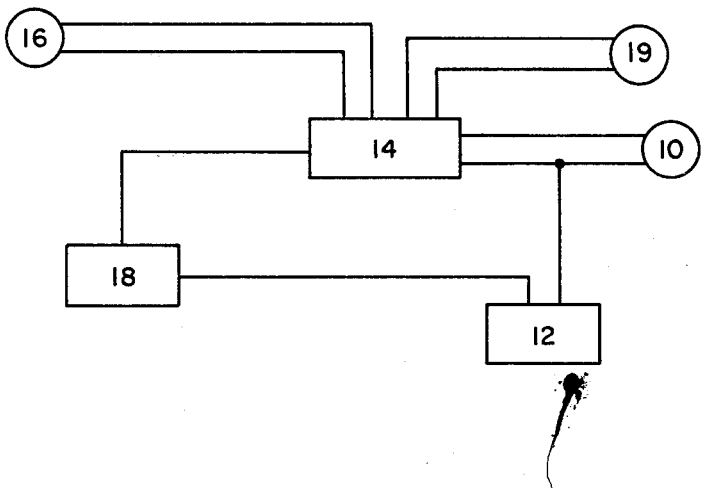
Fig. 1. PRIOR ART
FIG. 1 is a schematic drawing of a portion of the circuit of a conventional hot air oil burning furnace showing the electrical connections to the burner.
Figure 2:
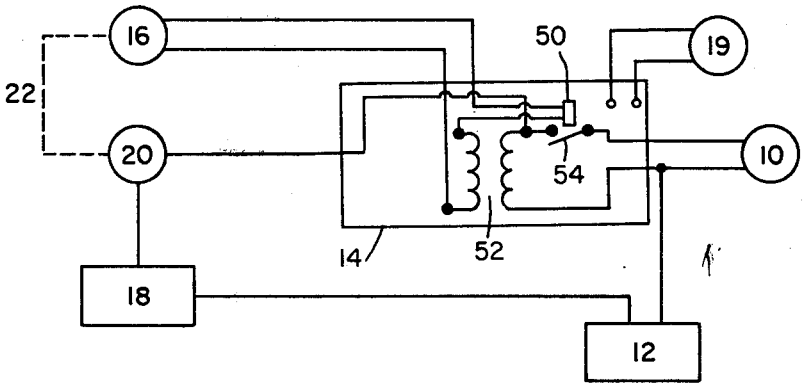
FIG. 2 is a schematic drawing as shown in FIG. 1 with the circuit of this invention, a safety line voltage thermostat connected between the limit switch and the control.

Referring to the drawing, and in particular to FIGS. 1 and 2, 10 represents a conventional burner in a hot air oil burner furnace, which is electrically connected to power source 12, usually conventional line voltage, and to a control circuit 14. Control circuit 14 is a conventional circuit used in hot air oil burning furnaces to actuate the burner 10 in response to various limiting circuits hereafter described.

A conventional low voltage thermostat 16 is electrically connected to control circuit 14. Thermostat 16 is positioned in a room of the building being heated by burner 10 and may be set at the temperature required in the room. Thermostat 16 is of the conventional type having a bi-metal element which bends in response to the outside temperature. When the outside temperature is lower than the setting of thermostat 16 the thermostat will activate, allowing a low voltage current to flow to control circuit 14 which turns on burner 10. Burner 10 is conversely turned off when thermostat 16 senses a temperature above that for which it has been set.

A limit switch 18 is connected between control circuit 14 and power source 12. Limit switch 18 is of a conventional type connected to the heat exchanger of burner 10 (not shown). If burner 10 fails to ignite cad cell 19 connected to control circuit 14 it will activate control circuit 14, which in turn will turn off burner 10. As may be seen, low voltage thermostat 16 is activated by a low voltage supplied by control circuit 14; hence it is possible for a malfunction in control circuit 14 to short out or deactivate low voltage thermostat 16. The limit switch 18 controls the burner 10 only after the heat exchanger (not shown) reaches a temperature of 220° F. or a predetermined temperature at which it is set. Cad cell 19 is a photo-electric cell device which senses the burning of the oil burner 10 in the furnace. When the oil burner is burning, cad cell 19 acts as a closed switch allowing current to flow therethrough.

When the oil burner 10 is not burning, cad cell 19 acts as an open circuit.

Referring now to FIG. 2, the circuit of this invention, line voltage or safety thermostat 20 is installed between limit switch 18 and control circuit 14. Dashed lines 22 indicate the ganging or connection between conventional low voltage thermostat 16 and the safety, line voltage thermostat 20. This ganging is of such a nature that when thermostat 16 is turned or set to a particular temperature that safety thermostat 20 will automatically be turned or set to a temperature about 10° above that of thermostat 16.

Referring now to the internal workings of Control 14 of FIG. 2, transformer 52 is a step-down transformer having a low voltage side and a high voltage side. The high voltage or 110 volt side is connected to burner 10 through a switch 54. Switch 54 in turn is activated by coil 50. Coil 50 is connected between room thermostat 16 and one terminal of the low voltage or 24 volt side of transformer 52. The other terminal of the low voltage side of transformer 52 is connected through to thermostat 16. When current flows through coil 50, switch 54 is closed, thus allowing line current to flow through the high voltage side of transformer 52, through switch 54 to burner 10, causing burner 10 to operate.

Line voltage safety thermostat 20 is connected to the power source 12 through limit switch 18 and to one terminal of switch 54. In operation, when room thermostat 16 signals for heat, its contact closes, allowing current from transformer 52 to flow through thermostat 16, coil 50 and back to the low voltage side of transformer 52. When current flows through coil 50 it closes switch 54 allowing line voltage to flow to burner 10, activating it. When line voltage safety thermostat 20 senses abnormal heat, the contact (not shown) in line voltage safety thermostat 20 opens, thus interrupting the line current passing from line power source 12 through limit switch 18. Hence the opening of room safety thermostat 20 interrupts the line voltage current to the high voltage side of transformer 52 causing burner 10 to turn off.

Figure 3:
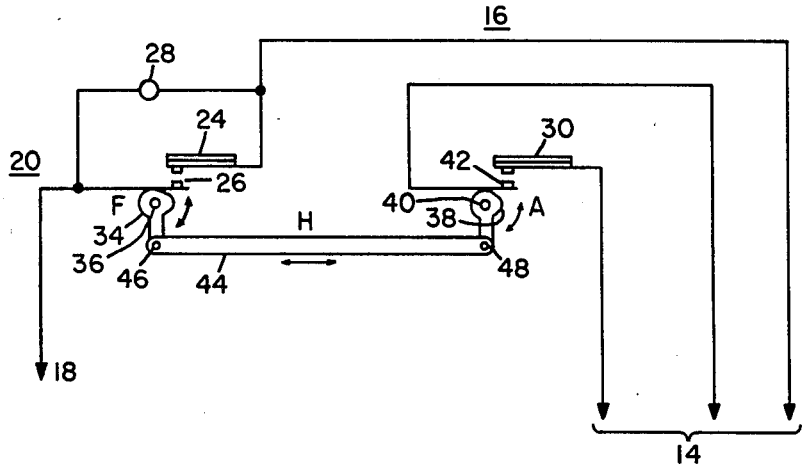
FIG. 3 is a more detailed drawing of the line voltage thermostat of the invention showing the ganging with the conventional low voltage room thermostat.

Referring now to FIG. 3, in line voltage thermostat 20, 24 represents the bi-metal element therein and 26 the contact point which said bi-metal element 24 touches to establish electrical contact. Contact 26 is connected to limit switch 18 (not shown) and bi-metal element 24 electrically connected to control circuit 14 (not shown). A neon light 28 is connected between bi-metal element 24 and contact 26. In line voltage thermostat 20 an eccentric cam 34 is pivoted upon pin 36. Eccentric cam 34 is rotably pivoted about pin 36 so that rotation of cam 34 forces contact 26 toward bi-metal element 24.

Referring now to low voltage thermostat 16, 30 represents a bi-metal thermostat element connected to the control circuit. A contact 42 is positioned adjacent to bi-metal element 30 and connected to the control circuit 14. An eccentric cam 38 is rotably pivoted about pin 40 so that the rotation of cam 38 forces contact 42 toward bi-metal element 30. A ganging element 44 is connected to cam 34 by pivot 46 on one end and to cam 38 by pivot 48 on the other end portion thereof, so that the rotation of cam 38 will automatically rotate cam 34.

In operation low voltage thermostat 16 is set to the desired room temperature by turning eccentric cam 38 about pin 40. The rotation of eccentric cam 38 causes ganging element 44 to rotate eccentric cam 34 about pin 36. Line voltage thermostat 20 is so set to activate at a temperature about 10° F. above that of low voltage thermostat 16.

While the room is warming up, bi-metal element 30 of low voltage thermostat 16 is in electrical contact with contact 42 allowing low voltage current to flow therethrough to control circuit 14. Control circuit 14 turns on burner 10 which causes hot air to enter the room in which low voltage thermostat 16 is located. When the preset temperature of low voltage thermostat 16 is reached, bi-metal element 30 bends away from contact 42, breaking the electrical connection and interrupting the low voltage current to control circuit 14. Control circuit 14 then turns off burner 10 and no more hot air enters the room where low voltage thermostat is located. When the temperature in the room again lowers below the setting of low voltage thermostat 16, the reverse process occurs.

In normal operation, line voltage thermostat 20 remains closed, that is bi-metal element 24 is in contact with contact 26. Hence a line voltage current flows, from limit switch 18, through line voltage thermostat 20 and into control circuit 14. If low voltage thermostat 16 shorts out or otherwise malfunctions so that burner 10 runs continuously, the temperature of the room will rise until it reaches 10° F. above the setting of low voltage thermostat 16. At this temperature bi-metal element 24 of the line voltage thermostat 20 will bend breaking the electrical connection with contact 26, and no more line voltage current will flow from limit switch 18 to control circuit 14. Control circuit 14 will then turn off burner 10. When the connection in line voltage thermostat 20 has been broken, a small amount of current will flow through neon light 28 causing it to glow as a warning that a malfunction has occurred in the furnace circuit.

We claim:

1. In a hot air oil burning furnace comprising in combination:

an oil burner electrically connected to a power source through a limit switch and a control circuit;

a low voltage thermostat electrically connected to said control circuit, adapted to activate said oil burner in response to the temperature sensed by said low voltage thermostat;

a thermostatically controlled safety device, comprising in combination:

a line voltage thermostat electrically connected between said limit switch and said control circuit;

means for said line voltage thermostat to shut off said oil burner in response to the temperature sensed by said line voltage thermostat;

means for setting said line voltage thermostat at a temperature above that of said low voltage thermostat;

said line voltage thermostat being positioned in the same location as said low voltage thermostat.

2. The combination as claimed in claim 1, in which said line voltage thermostat is comprised in combination:

a bi-metal temperature element;

a contact adapted to touch said bi-metal temperature element;

a rotable eccentric cam, in juxtaposition with said contact, the rotation of said cam adapted to move said contact toward said bi-metal temperature element;

a ganging element rotably connected with said eccentric cam and ganging element connected to said low voltage thermostat;

whereby the adjustment of said low voltage thermostat adjusts said line voltage thermostat.

3. The combination as claimed in claim 2, in which said line voltage thermostat is set to turn off said oil burner at a temperature above that to which said low voltage thermostat is set.

4. The combination as claimed in claim 3, in which said line voltage thermostat is set to turn off said oil burner at a temperature about 10° F. above that to which said low voltage thermostat is set.

5. The combination as claimed in claim 2, in which said line voltage thermostat has a signal light electrically connected between said bi-metal temperature element and said contact;

whereby said signal light will turn on when said line voltage thermostat has been activated.

6. The combination as claimed in claim 2, in which said low voltage thermostat is comprised of in combination:

a bi-metal temperature element;

a contact adapted to touch said bi-metal element;

a rotable eccentric cam, in juxtaposition with said contact, the rotation of said cam adapted to move said contact toward said bi-metal temperature element;

a ganging element rotably connected with said eccentric cam, said ganging element being connected to said rotable eccentric cam of said line voltage thermostat;

whereby the adjustment of said eccentric cam of said low voltage thermostat will adjust said eccentric cam of said line voltage thermostat.

* * * * *